US009447601B2

(12) United States Patent
Maillis et al.

(10) Patent No.: US 9,447,601 B2
(45) Date of Patent: Sep. 20, 2016

(54) PORTABLE ENVIRONMENTAL CONTAINMENT UNIT

(71) Applicants: Jack J. Maillis, Campbell, OH (US); Charlie Pizanias, Youngstown, OH (US)

(72) Inventors: Jack J. Maillis, Campbell, OH (US); Charlie Pizanias, Youngstown, OH (US)

( * ) Notice: Subject to any disclaimer, the term of this patent is extended or adjusted under 35 U.S.C. 154(b) by 0 days.

(21) Appl. No.: 14/609,794

(22) Filed: Jan. 30, 2015

(65) Prior Publication Data

US 2016/0222692 A1 Aug. 4, 2016

(51) Int. Cl.
*E04H 15/46* (2006.01)
*E04H 15/50* (2006.01)

(52) U.S. Cl.
CPC ..... *E04H 15/46* (2013.01); *E04H 15/50* (2013.01)

(58) Field of Classification Search
CPC ..... E04H 15/34; E04H 15/44; E04H 15/46; E04H 15/50; E04H 15/64
USPC ..... 135/121, 139–145, 151; 52/63, 86, 93
See application file for complete search history.

(56) References Cited

U.S. PATENT DOCUMENTS 1,170,188 A * 2/1916 Rasmussen et al. .... E04H 15/00 135/143
1,204,329 A * 11/1916 Wilkins ..... E04H 15/44 135/151
1,728,356 A * 9/1929 Morgan ..... E04H 15/50 135/154
2,335,274 A 11/1943 Hampton
2,928,403 A * 3/1960 Hoskins ..... E04H 15/28 135/116
3,121,470 A 2/1964 Stone
4,347,690 A * 9/1982 Wallace, Jr. ..... E04B 1/34326 135/160
4,649,947 A * 3/1987 Tury ..... E04H 15/18 135/117
4,739,592 A 4/1988 Molina
4,787,179 A 11/1988 Lewis
4,926,892 A 5/1990 Osmonson et al.
4,947,884 A * 8/1990 Lynch ..... E04H 15/50 135/145
5,331,777 A * 7/1994 Chi-Yuan ..... E04H 15/505 135/124
7,134,444 B2 11/2006 Mintie et al.
7,140,377 B1 * 11/2006 Dahulich ..... E04H 15/18 135/119
7,219,681 B1 * 5/2007 Hamilton-Jones .... E04H 15/322 135/119
7,584,763 B2 * 9/2009 Yoon ..... E04H 15/52 135/131

FOREIGN PATENT DOCUMENTS

JP 09112080 A * 4/1997 ..... E04H 15/34
JP 10018429 A * 1/1998 ..... E04H 15/34
JP 2009091767 A * 4/2009 ..... E04H 15/48

* cited by examiner

*Primary Examiner* — Winnie Yip
(74) *Attorney, Agent, or Firm* — Harpman & Harpman

(57) ABSTRACT

A portable adaptable enclosure for providing environmental control and containment of contaminants for a variety of onsite applications. The enclosure utilizes a limited number of tubular construction elements that are interlinked together to form an integrated expandable use enclosure defined by extending interengaging vertical and horizontal tubular elements in a terrain adaptable extensible structure. Telescopically adjust support elements with interengaging multi-directional attachment fittings allow for successive erection and extension in linear and off access orientation in a sequential step fashion to follow work defined directional requirements in the field.

4 Claims, 5 Drawing Sheets

PORTABLE ENVIRONMENTAL CONTAINMENT UNIT

BACKGROUND OF THE INVENTION

1. Technical Field

This invention relates to portable temporary tent-like constructions used to temporarily enclose a work area for maintenance or construction related actions so as to be shielded from the environmental elements. Such constructions are also used as containment enclosures preventing contaminants from being released from the enclosure into the environment.

2. Description of Prior Art

Prior art devices of this type have been directed to a variety of containment systems and constructions, see for example U.S. Pat. Nos. 2,335,274, 3,121,470, 4,739,592, 4,787,178, 4,926,892 and 7,134,444.

U.S. Pat. No. 2,335,274 discloses a portable welding screen having multiple supports bolted together along a single plane to form a safety screen.

U.S. Pat. No. 3,121,470 claims a protective covering for a scaffold wherein a flexible sheet of material overlies and is secured to the vertical support elements of a scaffolding.

U.S. Pat. No. 4,739,592 illustrates a protective awning for a scaffolding and tubular structure having a sheet of covering material fitted on the bearing structure formed from tubular elements. A tightening mechanism allows for tightening of the sheet so as to be secured thereon and thereover.

U.S. Pat. No. 4,787,176 discloses an abrasive blasting containment system wherein an enclosure is formed by a tubular support frame on which flexible material is attached.

U.S. Pat. No. 4,926,892 claims a temporary enclosure structure formed of interengaging tubular framed elements and side frame sections of vertical and horizontal members with multiple pipe sections oriented therewith.

Finally, in U.S. Pat. No. 7,134,444 an environmental containment unit is disclosed having a portable enclosure providing a flexible envelope attached to an interior support of vertical and horizontal collapsible frame elements.

SUMMARY OF THE INVENTION

A portable self-supporting enclosure frame system for field applications having interengagement, vertical and horizontal frame members with selective unidirectional frame attachment fittings for sequential frame assembly and disassembly in progressive adapted sections. Longitudinally adjustable cross support frame members and independent vertically extensible posts accommodate terrain variations and work defined area requirements. Longitudinal frame stabilization tensioning elements between vertical post elements and transversely adjustable upstanding interengagement rafter define frame elements to accommodate height requirements and incumbent weather protection by inclusive over covering sheet material secured thereto.

DETAILED DESCRIPTION OF THE INVENTION

Figure 1:
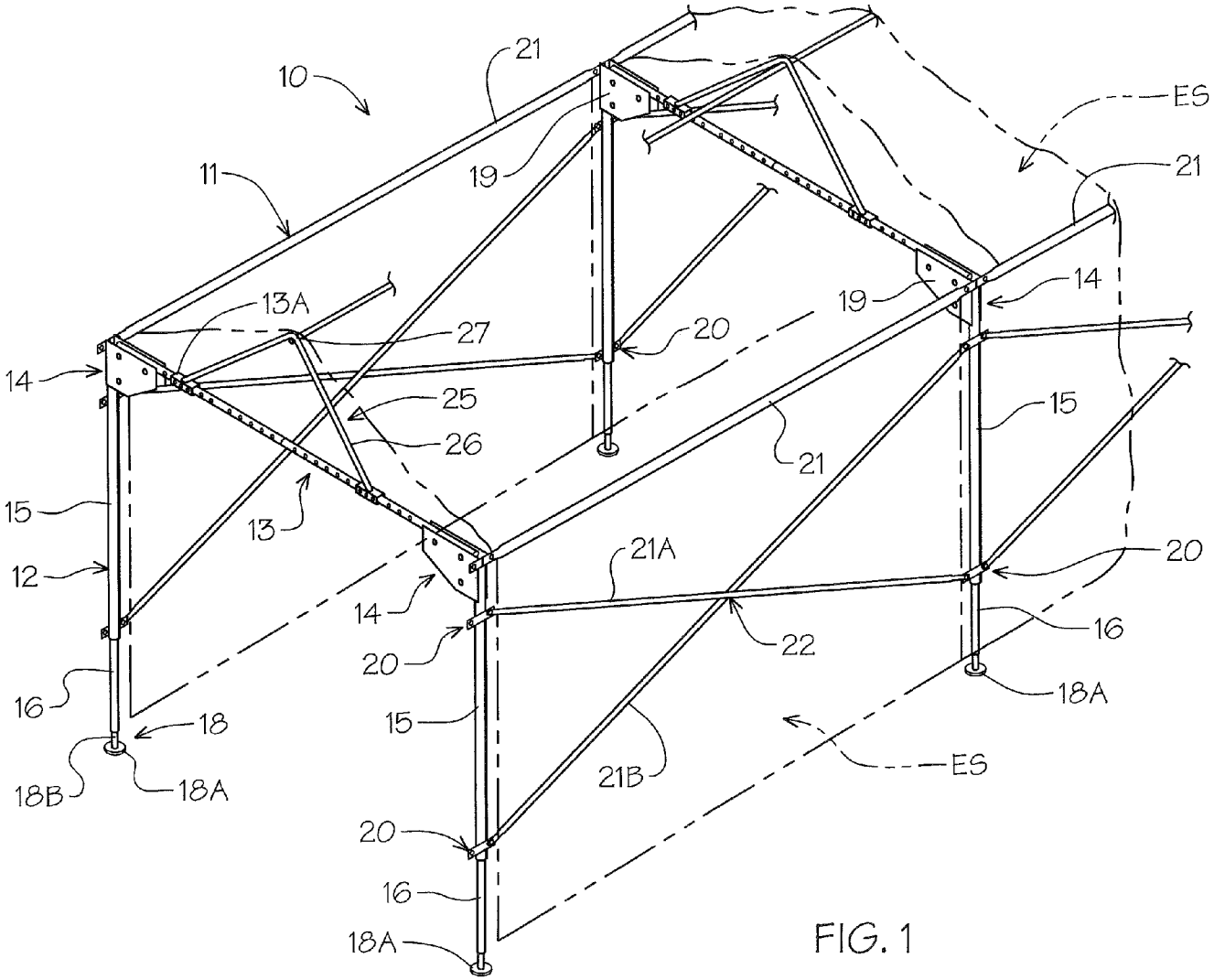
FIG. 1 is a perspective view of the portable enclosure structure of the invention.

Referring now to FIG. 1 of the drawings, a portable expansible enclosure 10 of the invention can be seen having a main support frame 11 with multiple vertical support post 12 and interlocking horizontally disposed cross frame elements 13. The vertical support post 12 and interlocking cross frame elements 13 are removably secured to one another by a mounting attachment assembly 14 on each of said support post 12 to define an expansible, interchangeable and multidirectional support frame construction thereby adapted to non-uniform and continuous work areas as required.

Each of the vertical support posts 12 has an upper tubular portion 15 and a telescopically adjustable extensible lower portion 16 therewithin. A plurality of longitudinally spaced apertures A within each of the post portions 15 and 16 are provided for adjustable alignment engagement by a spring urged pop pin assembly 17 which are permanently secured by welding to the surface of the upper tubular post portion 15 allowing for selective incremental longitudinal deployment and locking of the slidably disposed inner lower post portion 16 as best seen in FIG. 2 of the drawings.

A leveling post support foot 18 assembly has a ground engagement pad 18A and an extending threaded rod 18B which is threadably disposed within the free end of each of said lower post portion 16 via a receiving nut end N secured there within as well be well understood by those skilled in the art.

It will be seen that each of the vertical support post 12 can be adjustably extended vertically and locked in place to accommodate overall support frame 11 height requirements and adapted to uneven ground terrain GT as illustrated in broken lines.

Figure 2:
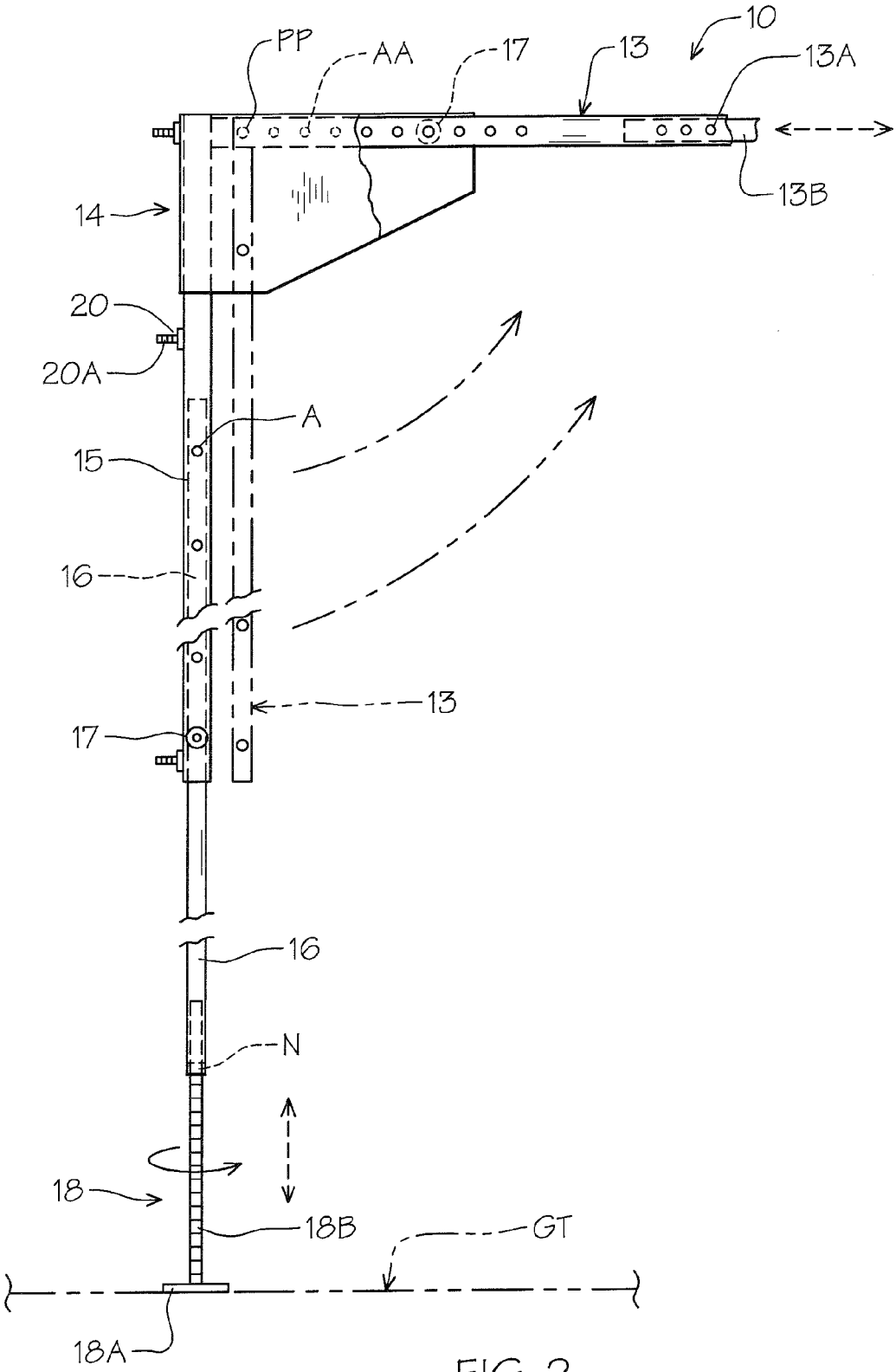
FIG. 2 is an enlarged partial front elevational view of an adjustable support frame post.
Figure 3:
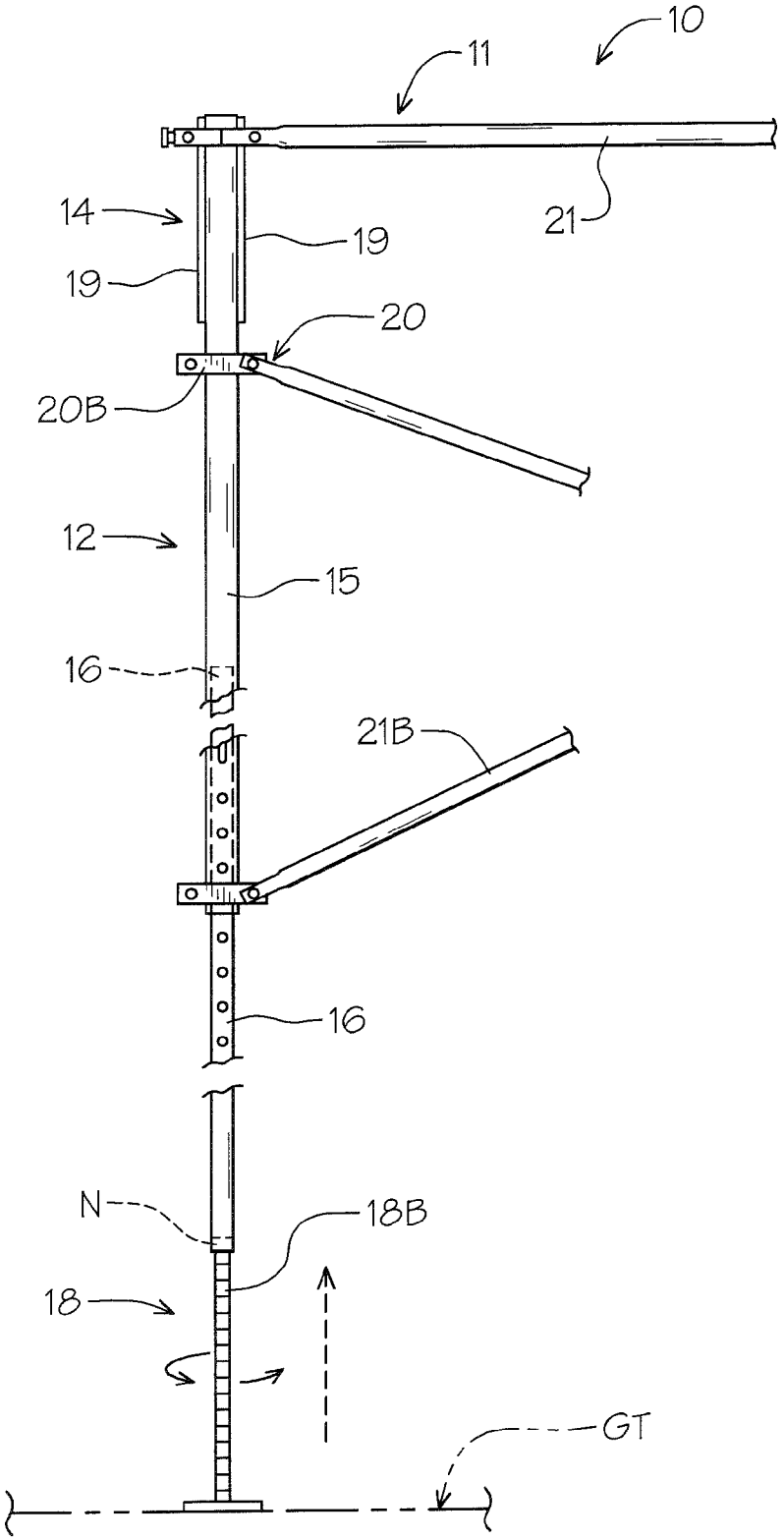
FIG. 3 is an enlarged partial side elevational view thereof.

Each of the fastener assemblies 14, best seen in FIGS. 2 and 3 of the drawings, have a pair of identical engagement plates 19 which are welded on the respective free ends of the support posts 12 and extend at right angles therefrom in spaced parallel relation to one another. The plate pairs 19 have aligned apertures AA extending in longitudinally and vertical relation for registerable engagement with corresponding mounting apertures AA in the respective cross frame elements 13.

A pop pin assembly 17 secured over one of the apertures AA is provided for selective removable locking of the cross frame element 13 into horizontal transverse angular use alignment therebetween. A pivot pin PP secures the respective aperture ends of the cross frame elements 13 between the spaced plates 19 for pivotal deployment thereof indicated by directional broken arrows shown in FIG. 2 of the drawings.

It will be seen that a plurality of threaded mounting bolt fittings 20 are secured to and extend outwardly from each of the support posts 12. The threaded mounting bolt fittings 20 have a rectangular base mounting plate 20A which is preferably welded to the outer surface of the upper tubular portion 15 in longitudinal alignment with one another with a pair of engagement bolts 20B extending therefrom. The engagement bolts 20B provide attachment points for interconnecting respective side rails 21 between spaced support posts 12 as seen in FIG. 1 of the drawings.

The side rails 21 are preferably of a tubular configuration having a fixed length with oppositely disposed aperture end fittings for retaining engagement over correspondingly aligned mounting bolt fittings 20 extending across respective plate pairs 19 edges adjacent their tops as best seen in FIG. 3 of the drawings. This fixed length orientation determines the maximum length of any of the portable enclosures frame elements assuring ease of transportation with no specialized vehicle requirement or associated support fixtures thereon.

Each of the cross frame elements 13 are selectively secured between the correspondingly parallel spaced engagement plates 19, as noted, and therefore the respective base support post 12 and are longitudinally adjustable having a telescopically disposed tubular construction.

It will be seen that an outside support tube 13A has a resilient pop pin PP thereon for engagement with an interior tube 13B of a reduced diameter extending from its pivotal engagement therewithin.

Each of the corresponding cross frame elements 13 can therefore be extended longitudinally and fixed in place as needed to accommodate the width of a work area requirement.

The threaded mounted bolt fittings 20 provide engagement retainment for pairs of side braces 21A and 21B that extend cross wise between support posts 12 in planar relationship to the hereinbefore described respective upper side rails as best seen in FIG. 1 of drawings and partially in FIG. 3 of the drawings. The tubular braces 21A and 21B are flattened at the respective distal ends with a mounting aperture therewithin. The braces 21A and 21B are secured to the respective post 12 in angular crossing relationship and are pinned to one another at central aligned apertures at 22.

Figure 4:
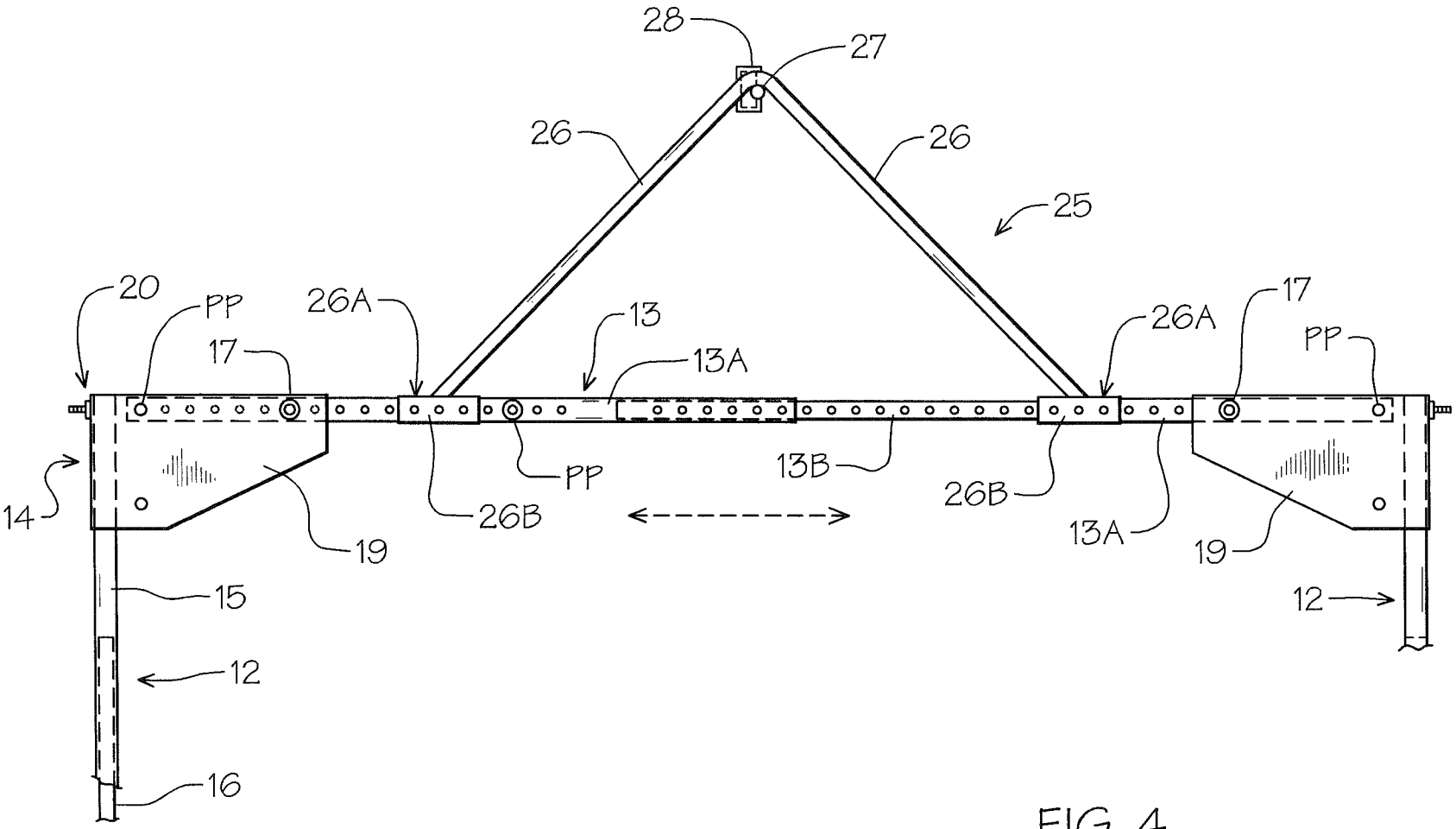
FIG. 4 is an enlarged partial front elevational view of an adjustable rafter support frame element.
Figure 6:
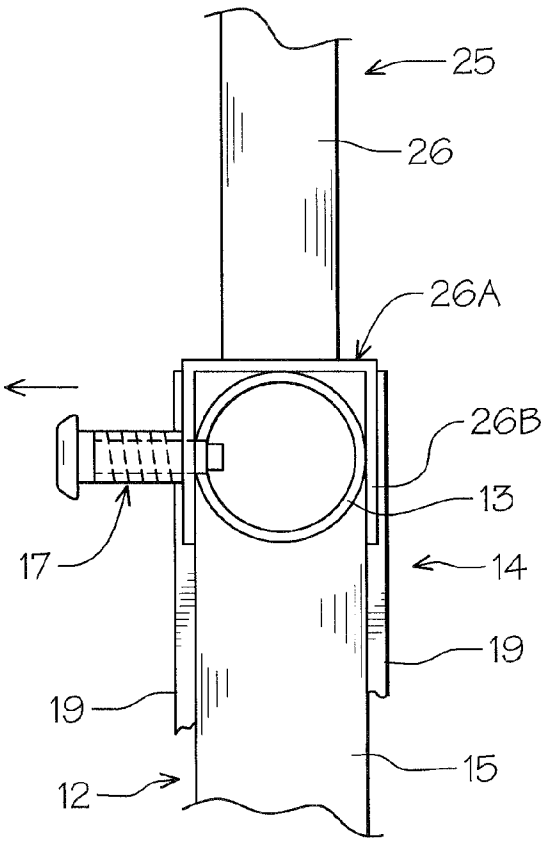
FIG. 6 is an enlarged broken away cross sectional view of the adjustable rafter support frame engagement mounting configuration.
Figure 5:
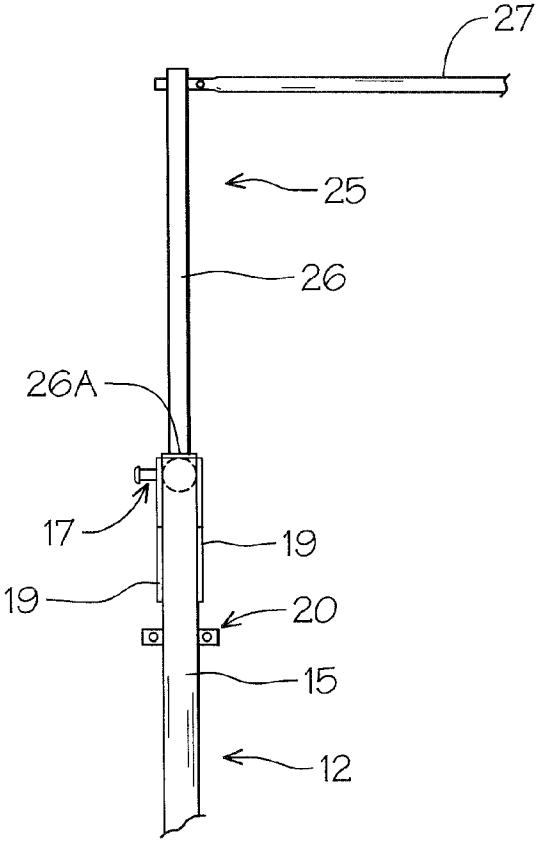
FIG. 5 is an enlarged partial side elevational view thereof.

Referring now to FIGS. 4, 5 and 6 of the drawings an optional cross frame attachment can be seen wherein an elevated truss frame and beam support assembly 25 provides for adjustable attachment to each of cross frame elements 13. The frame and beam support assembly 25 has an upstanding angular tubular truss element 26 with channel frame engagement fitting 26A on oppositely disposed free ends thereof. Each of the channel frame fittings 26A has apertured sidewalls 26B and is of a dimension slidably engaging over and on the respective cross frame elements 13.

Once of a pair of frame and beam assemblies 25 are engaged in spaced parallel relation to one another, a tubular truss beam 27 is positioned to extend therebetween at their respective apex. A pipe fitting 28 is secured to each of the truss elements 26 thereby slidably receiving the respective free ends of a tubular truss beam 27 therein as best seen in FIGS. 4 and 5 of the drawings. This optional assembly provides for added height and affords an angular inclination when covered with a weather resistant sheet as illustrated in broken lines in the preferred embodiment in FIG. 1 of the drawings.

In view of the following descriptions, it will be evident that in use the main support frame 11 once broken down can be easily transported to a work site and reassembled to the size and configuration needed. Containment and environmental element sheets ES shown in broken lines graphically in FIG. 1 of the drawings are secured over the frame providing a self-supporting portable enclosure for the work site WS such as a pipeline application, not shown. The main support frame 11 can be selectively moved along the site as required by disassembling post sections, cross frames and side rail elements 13 and 21 and then reassembling in a sequential stepped manner. Additionally, given the post 12 annular orientation the effective directionality of the enclosure can be configured to conform to the work site directional changes which are typically encountered in the field with a minimum amount of frame elements being assembled and then reassembled as noted in a sequential step-like progressive fashion and directional orientation required.

It will thus be seen that a new and useful portable enclosure for work site venue has been illustrated and described and it will be apparent to those skilled in the art that various changes and modifications may be made thereto without departing from the spirit of the invention.

Therefore we claim:

1. A portable expandable temporary enclosure structure comprising, a main support frame having multiple frame sections including, a plurality of vertically adjustable tubular support posts in spaced parallel relation to one another, telescopically extensible cross horizontal frame elements pivotally attached from each of said respective vertical support posts, said telescopically extensible cross horizontal frame elements are slidably engaged and secured within one another on their respective free effacing ends defining at least two horizontal adjustable planar frames sections, a plurality of frame mounting bolt fittings on each of said vertical posts, side frame sections including at least two fixed tubular side rails selectively secured between said respective vertical posts of each planar frame sections, pairs of crisscrossed side braces removably secured on said frame mounting bolts fittings between said vertical posts of each of said planar frame sections, mounting attachment assemblies for pivotally attaching each of said telescopically extensible cross horizontal elements and said fixed side rails to said vertical support post, a cross frame attachment selectively secured to said respective telescopically extensible cross horizontal frame elements comprises, frame and beam support assemblies, an upstanding angular tubular truss with cross horizontal frame engagement fittings in spaced relation to respective vertical support post and a truss bean extend between said respective tubular truss.

2. The portable expandable temporary enclosure structure set forth in claim 1 wherein said mounting attachment assemblies on said respective vertical support posts comprises, pairs of parallel aligned aperture plates affixed on said respective vertical support posts extending outwardly therefrom.

3. The portable expandable temporary enclosure structure set forth in claim 1 wherein said respective telescopically extensible cross horizontal frame elements adjustably engage within one another each having selectively aligned apertures for fixed locking pin engagement in said aligned apertures.

4. The portable expandable temporary enclosure structure set forth in claim 1 further comprises flexible sheet material extending over said frame sections.

* * * * *